US010689218B2

(12) United States Patent
Chino et al.

(10) Patent No.: US 10,689,218 B2
(45) Date of Patent: Jun. 23, 2020

(54) PRINTING APPARATUS

(71) Applicant: MIMAKI ENGINEERING CO., LTD., Nagano (JP)

(72) Inventors: Hashiru Chino, Nagano (JP); Shin Ito, Nagano (JP); Takamichi Takeda, Nagano (JP); Tomohiro Takano, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 66 days.

(21) Appl. No.: 15/960,567

(22) Filed: Apr. 24, 2018

(65) Prior Publication Data

US 2018/0312358 A1 Nov. 1, 2018

(30) Foreign Application Priority Data

Apr. 28, 2017 (JP) ..... 2017-090683

(51) Int. Cl.

| | |
|---|---|
| ***B41J 15/16*** | (2006.01) |
| ***B65H 23/14*** | (2006.01) |
| ***B41J 3/407*** | (2006.01) |
| ***B41J 15/04*** | (2006.01) |
| ***B65H 20/06*** | (2006.01) |

(Continued)

(52) U.S. Cl.

CPC ..... *B65H 23/14* (2013.01); *B41J 3/4078* (2013.01); *B41J 11/007* (2013.01); *B41J 15/048* (2013.01); *B41J 15/16* (2013.01); *B41J 15/165* (2013.01); *B65H 20/02* (2013.01); *B65H 20/06* (2013.01); *B65H 23/08* (2013.01); *B65H 23/105* (2013.01); *D06P 5/30* (2013.01);

(Continued)

(58) Field of Classification Search

CPC ..... B65H 23/08; B65H 23/14; B65H 23/105; B65H 20/02; B65H 20/06; B41J 11/007; B41J 15/16; B41J 15/165

See application file for complete search history.

(56) References Cited

U.S. PATENT DOCUMENTS 2,595,325 A * 5/1952 Baumgartner ..... B65H 23/02 242/615.3
4,863,086 A * 9/1989 Armelin ..... B65H 20/08 226/152

(Continued)

FOREIGN PATENT DOCUMENTS

JP 2016185611 10/2016

*Primary Examiner* — Sang K Kim
(74) *Attorney, Agent, or Firm* — JCIPRNET

(57) ABSTRACT

A printing apparatus capable of fixing a medium appropriately during printing is provided. The printing apparatus includes a feeding roller, a printing portion configured to make a print on the textile supplied from the feeding roller, and a conveyance portion configured to convey the textile to the printing portion. The conveyance portion includes a pressure roller configured to sandwich the textile and rotate along with conveyance of the textile. The printing apparatus further includes a brake roller disposed between the pressure roller and the feeding roller for producing force acting on the textile against conveyance force for the textile by the conveyance portion to apply tension to the textile between the brake roller and the pressure roller. Tension smaller than tension exerted on the textile between the brake roller and the pressure roller is exerted on the textile between the brake roller and the feeding roller.

11 Claims, 3 Drawing Sheets

(51) Int. Cl.

| | |
|---|---|
| ***B65H 20/02*** | (2006.01) |
| ***D06P 5/30*** | (2006.01) |
| ***B65H 23/10*** | (2006.01) |
| ***B65H 23/08*** | (2006.01) |
| ***B41J 11/00*** | (2006.01) |

(52) U.S. Cl.
CPC ..... *B65H 2301/4493* (2013.01); *B65H 2404/1441* (2013.01); *B65H 2404/261* (2013.01); *B65H 2701/174* (2013.01)

(56) References Cited

U.S. PATENT DOCUMENTS 5,883,654 A * 3/1999 Katsuyama ..... B65H 20/02 347/104
6,074,054 A * 6/2000 Katsuyama ..... B41J 3/4078 226/145

* cited by examiner

PRINTING APPARATUS

CROSS REFERENCE TO RELATED APPLICATIONS

This application claims the priority benefit of Japanese Patent Application No. 2017-090683, filed on Apr. 28, 2017. The entirety of the above-mentioned patent application is hereby incorporated by reference herein and made a part of this specification.

TECHNICAL FIELD

The present disclosure relates to a printing apparatus.

BACKGROUND ART

Printing apparatuses for making a print on a sheet-like medium such as cloth are known. In such a printing apparatus, a roll of a sheet-like medium is set in a medium supply portion. The medium fed from the roll is conveyed by a conveyance mechanism and set onto the printing surface of a platen. After making a print on the printing surface of the medium, the printing apparatus allows the conveyance mechanism to convey the medium to a take-up portion and allows the take-up portion to take up the medium.

The printing apparatus described in Japanese Unexamined Patent Application Publication No. 2016-185611 includes a conveyance portion having an endless belt and makes a print on a medium conveyed by the endless belt. Upstream in the conveyance direction, a pressure roller is provided for pressing a medium against the endless belt. The pressure roller presses a medium against the endless belt whereby the medium is adhesively fixed to an adhesion layer formed on a surface of the endless belt.

Patent Literature: Japanese Unexamined Patent Application Publication No. 2016-185611

SUMMARY

In the printing apparatus described in Japanese Unexamined Patent Application Publication No. 2016-185611, a second pressure roller for pressing a medium against the endless belt is provided between the pressure roller and a support plate for supporting the medium on the endless belt. This configuration can prevent or suppress a change in tension of the endless belt when the medium is pressed against the endless belt.

However, Japanese Unexamined Patent Application Publication No. 2016-185611 does not examine the tension exerted on the medium. When tension is exerted on the medium, the medium may be stretched depending on its kind, and damage caused by the stretching of the medium may occur. In addition, if the tension exerted when the pressure roller presses the medium varies, the manner in which the medium is fixed may vary although the medium is pressed with a constant pressure force.

In view of the background described above, the present disclosure provides a printing apparatus in which a section under a large tension on the conveyed medium is reduced.

A printing apparatus of the present disclosure includes a feeding roller configured to feed and supply a medium from a roll of the medium, a printing portion configured to make a print on the medium supplied from the feeding roller, and a conveyance portion configured to convey the medium to the printing portion. The conveyance portion includes a rotation roller configured to sandwich the medium and rotate along with conveyance of the medium. The printing apparatus further includes brake device disposed between the rotation roller and the feeding roller so as to produce a force acting on the medium against a conveyance force for the medium by the conveyance portion. Tension smaller than tension exerted on the medium between the brake device and the rotation roller is exerted on the medium between the brake device and the feeding roller. Such brake device applies the force against the conveyance force for the medium to reduce the tension exerted upstream from the brake device, thereby reducing damage caused by stretching of the medium.

In the printing apparatus of the present disclosure, the conveyance portion may convey textile serving as the medium. In general, when the medium is textile, tension exerted on the medium is large. The present disclosure has a significant effect of reducing tension exerted on the textile upstream from the brake device.

In the printing apparatus of the present disclosure, the conveyance portion may include a belt and convey the medium sandwiched between the rotation roller and the belt and adhering to the surface of the belt. In the conveyance portion that conveys the medium adhering to the surface of the belt, large tension may be exerted on the medium. The present disclosure can reduce the tension exerted on the textile upstream from the brake device.

In the printing apparatus of the present disclosure, the rotation roller may be rotated by conveyance of the medium by the belt. With this configuration, while rotating, the rotation roller allows the medium to adhere to the belt appropriately.

In the printing apparatus of the present disclosure, the brake device may be provided at a position closer to the rotation roller than a position away from the rotation roller by a half-length of the medium from the feeding roller to the rotation roller. With this configuration, the distance from the brake device to the rotation roller is reduced whereby tension variation for this distance can be suppressed.

The printing apparatus of the present disclosure may include a tension bar configured to apply tension to the medium fed by the feeding roller, between the feeding roller and the brake device. With this configuration, the state of the medium conveyed between the feeding roller and the brake device can be kept appropriate.

In the printing apparatus of the present disclosure, the brake device may be a roller having a predetermined rotational resistance. With this configuration, the rotational resistance acts as braking force on the medium.

In the printing apparatus of the present disclosure, the brake device may include a second roller configured to pinch the medium in cooperation with the roller. This configuration increases the friction force of the roller and facilitates transfer of the rotational resistance to the medium.

In the printing apparatus of the present disclosure, the roller may be configured to rotate along with conveyance of the medium. This configuration can brake the medium without damaging the surface of the medium.

In the printing apparatus of the present disclosure, the brake device may be a pin having a predetermined friction force. With this configuration, the friction force acts as braking force on the medium.

The present disclosure can reduce the section under a large tension on the conveyed medium and can reduce damage caused by stretching of the medium.

DESCRIPTION OF EMBODIMENTS

A printing apparatus according to embodiments of the present disclosure will be described below with reference to the drawings. In the embodiments described below, textile is taken as an example of the medium to be printed. The medium to be printed in the present disclosure, however, is not limited to textile. The present disclosure is applicable to printing on continuous media, for example, applicable to printing on continuous paper.

First Embodiment

Figure 1:
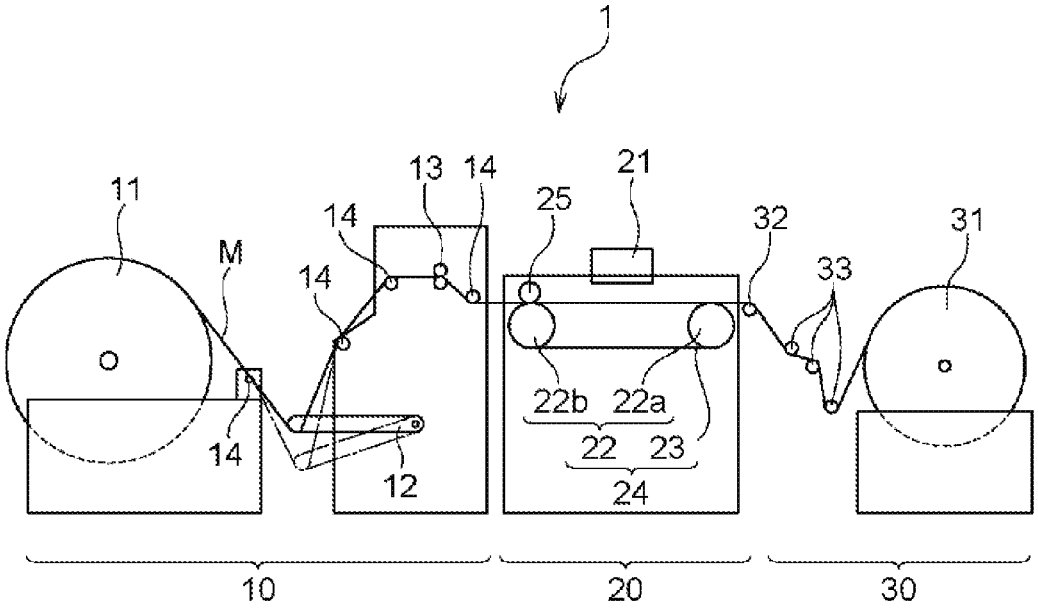
FIG. 1 is a diagram illustrating an overall configuration of a printing apparatus in the present embodiment.

FIG. 1 is a diagram illustrating a configuration of a printing apparatus 1 in the present embodiment. The printing apparatus 1 in the present embodiment is an apparatus that makes a print on textile M as a medium. The printing apparatus 1 mainly includes a textile supply portion 10 that supplies the textile M, a printing portion 20 that makes a print on the textile M, and a take-up portion 30 that takes up the printed textile M.

The textile supply portion 10 includes a feeding roller 11 in which a roll of the textile M as a print medium is set, a plurality of guide rollers 14 that guide the textile M to the printing portion 20, a tension bar 12 that applies a certain tension to the textile M, and a brake roller 13 for preventing the tension exerted on a path on the textile supply portion 10 side from affecting the printing portion 20. The brake roller 13 corresponds to "brake device" in the present disclosure.

The feeding roller 11 rotates intermittently and feeds the textile M. The tension bar 12 moves upward as the textile M flows to the downstream side. The tension bar 12 has the function of determining a timing for the feeding roller 11 to feed the textile M and, when moving up to a certain height, gives an instruction to the feeding roller 11 to feed the textile M. In accordance with this instruction, the feeding roller 11 rotates by a certain amount to feed the textile M, and the tension bar 12 moves downward.

Since the textile M receives tensile force from the printing portion 20 located downstream, the tension causes the textile to stretch and may damage the textile. If the distance from the printing portion 20 to the feeding roller 11 is long, the section in which stretching of the textile M occurs due to tension is long. In the printing apparatus 1 in the present embodiment, the brake roller 13 limits the section under a large tension, to a part of the section from the feeding roller 11 to the printing portion 20. The brake roller 13 will be described later.

The printing portion 20 includes an inkjet head 21 that applies ink to the textile M and a conveyance portion 24 that conveys the textile M in a region of printing by the inkjet head 21. The conveyance portion 24 is configured to convey the textile M to be printed by the printing portion 20 while supporting the textile M so as to be opposed to the inkjet head 21.

The conveyance portion 24 is configured such that a belt 23 is looped over two rotation shafts 22. Of the two rotation shafts 22, the downstream rotation shaft 22 is a driving roller 22*a* that gives driving force for rotating the belt 23, and the upstream rotation shaft 22 is a driven roller 22*b* that is rotated along with the rotation of the belt 23. Although the driving roller 22*a* is disposed downstream in the present embodiment, the driving roller 22*a* may be disposed upstream and the driven roller 22*b* may be disposed downstream.

The surface of the belt 23 is coated with an anti-wrinkle agent. A pressure roller 25 is provided at a position opposed to the driven roller 22*b* in the conveyance portion 24 with the belt 23 interposed. The pressure roller 25 corresponds to the "rotation roller" of the present disclosure. The textile M is sandwiched between the pressure roller 25 and the belt 23 and is pressed against the belt 23, whereby the textile M sticks to the surface of the belt 23 to be fixed. Since the textile M is fixed during printing, a print can be made appropriately on the textile M.

After printing, the textile M is guided by a guide roller 32 and a plurality of guide rollers 33 to the take-up portion 30 and taken up by a take-up roller 31. An overall configuration of the printing apparatus 1 in the present embodiment has been described above.

Figure 2:
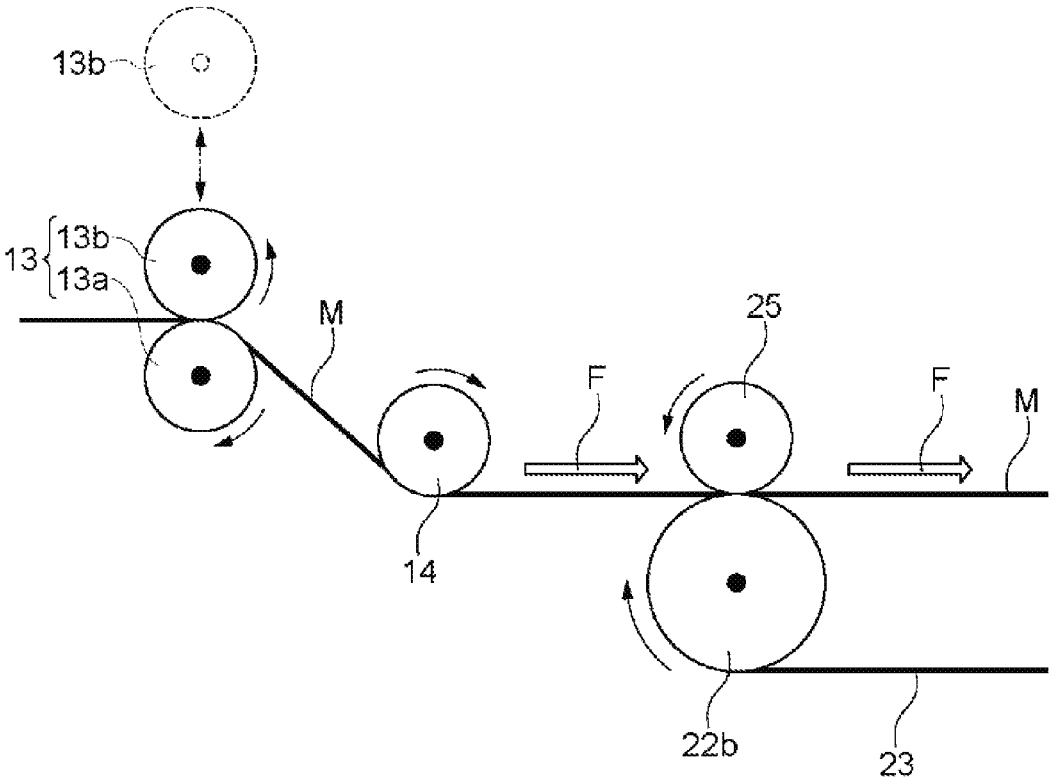
FIG. 2 is an enlarged view illustrating a configuration of a brake roller.

FIG. 2 is an enlarged view of the configuration around the brake roller 13. The brake roller 13 includes a pair of rollers 13*a* and 13*b*. The upper roller 13*b* is movable upward and downward. When the textile M is set in the printing apparatus 1, the upper roller 13*b* is moved upward. When printing is performed in the printing apparatus 1, the upper roller 13*b* is moved downward so as to pinch the textile M.

A not-illustrated slip tape is wound around the roller 13*a*. The textile M is sandwiched between the roller 13*a* and the roller 13*b* so that no slippage occurs between the roller 13*a* and the textile M. Accordingly, when the textile M flows downstream in the conveyance direction as indicated by an arrow F and passes through between the pair of rollers 13*a* and 13*b*, the roller 13*a* is rotated by the conveyance of the textile M. Since rotational resistance is applied to the roller 13*a* by an air brake, the rotational resistance of the roller 13*a* acts as braking force on the textile M.

The brake roller 13 is disposed upstream of the pressure roller 25, preferably located as close as possible to the pressure roller 25. In the present embodiment, the brake roller 13 is provided at a position closer to the pressure roller 25 than a position away from the rotation roller by a half-length of the medium from the feeding roller 11 to the pressure roller 25. Preferably, the brake roller 13 is disposed immediately before the pressure roller 25, and specifically, the distance between the brake roller 13 and the pressure roller 25 is shorter than the width of the textile M. Setting such a distance can reduce the section in which stretching of the textile M may occur, and can suppress occurrence of damage to the textile M.

The upstream side from the brake roller 13 is configured such that tension exerted on the textile M is minimized. Since tension is applied between the brake roller 13 and the pressure roller 25, substantially tension need not be applied upstream from the brake roller 13. It is noted that if tension is zero, inconvenience may arise in conveyance of the textile M, and in some cases, the loosened textile M may be wrinkled when its conveyance is resumed. It is therefore desirable that tension should be applied upstream from the brake roller 13 to a degree that does not cause inconvenience in conveyance.

Second Embodiment

A printing apparatus in a second embodiment of the present disclosure will now be described. The basic configuration of the printing apparatus in the second embodiment is the same as the printing apparatus 1 in the first embodiment, except for the configuration for braking the textile M flowing downstream. Specifically, the printing apparatus in the first embodiment is configured such that the textile M is sandwiched, whereas the printing apparatus in the second embodiment includes a pin 15 over which the textile M is looped.

Figure 3:
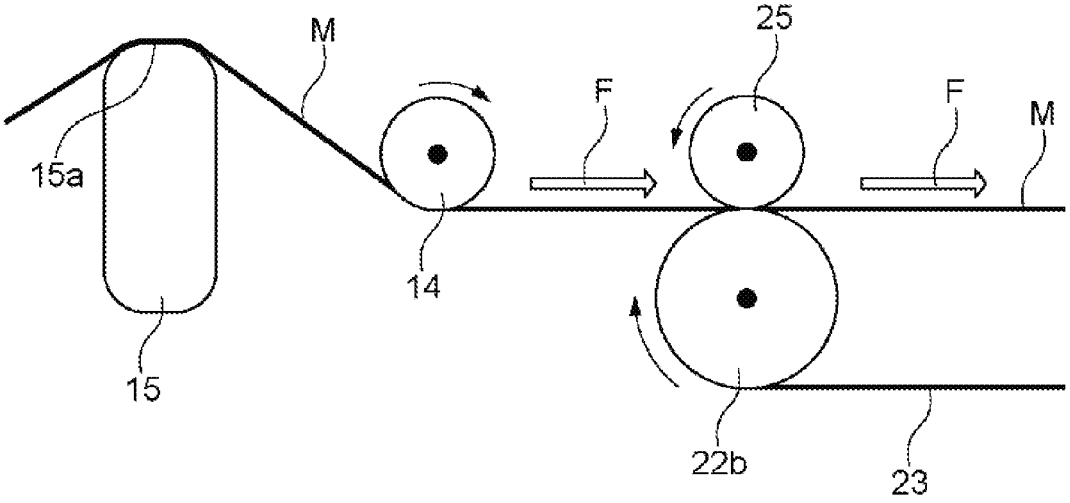
FIG. 3 is an enlarged view illustrating a configuration of a pin.

FIG. 3 is an enlarged view of the configuration around the pin 15 corresponding to the brake device in the present disclosure. As illustrated in FIG. 3, the printing apparatus in the second embodiment includes the pin 15 instead of the brake roller 13 in the printing apparatus 1 in the first embodiment. The pin 15 has a front end portion 15*a* having a predetermined surface coarseness. The textile M is looped over the front end portion 15*a* of the pin 15.

When the textile M flows downstream in the conveyance direction as indicated by the arrow F and passes through the front end portion 15*a* of the pin 15, kinetic friction force is produced between the textile M and the front end portion 15*a*. The kinetic friction force acts as braking force on the textile M. The magnitude of the kinetic friction force exerted on the textile M can be changed according to the surface coarseness of the front end portion 15*a* of the pin 15 and/or the angle of the textile M looped over the pin 15.

Although the printing apparatus in the embodiments of the present disclosure has been described above, the printing apparatus of the present disclosure is not limited to the foregoing embodiments and is susceptible to various modifications. For example, a configuration that brings a member having a certain adhesion into contact with the textile M may be employed as the configuration of applying force against the flow of the textile M in the conveyance direction.

In the foregoing embodiments, of the rotation shafts having the belt 23 looped thereon, the driving roller 22*a* rotates to produce conveyance force in the conveyance portion 24. Alternatively, both of the rotation shafts having the belt 23 looped thereon may be driven rollers, and rotation force may be applied to the pressure roller 25 to convey the medium.

In the foregoing embodiments, the conveyance portion 24 includes the belt 23. However, the conveyance portion 24 may not necessarily include the belt 23 and, for example, may be configured with a feed roller and a plurality of pinch rollers in combination.

Effects of Embodiments (1) The printing apparatus 1 in the present embodiment includes a feeding roller 11, a printing portion 20 configured to make a print on textile M supplied from the feeding roller 11, and a conveyance portion 24 configured to convey the textile M to the printing portion 20. The conveyance portion 24 includes a pressure roller 25 configured to sandwich the textile M and rotate along with conveyance of the textile M. The printing apparatus 1 further includes a brake roller 13 disposed between the pressure roller 25 and the feeding roller 11 for producing force acting on the textile M against conveyance force for the textile M by the conveyance portion 24 to apply tension to the textile M between the brake roller 13 and the pressure roller 25. Tension smaller than tension exerted on the textile M between the brake roller 13 and the pressure roller 25 is exerted on the textile M between the brake roller 13 and the feeding roller 11. In this way, the brake roller 13 applies force against the conveyance force for the textile M to reduce the tension exerted upstream from the brake roller 13 and reduce damage caused by stretching of the textile M.

(2) In the printing apparatus 1 in the present embodiment, the conveyance portion 24 conveys textile. In general, when the medium is the textile M, tension exerted on the textile M is large. The present embodiment has a significant effect of reducing tension exerted on the textile M upstream from the brake roller 13.

(3) In the printing apparatus 1 in the present embodiment, the conveyance portion 24 includes a belt 23 and conveys the textile M sandwiched between the pressure roller 25 and the belt 23 and adhering to the surface of the belt 23. In the conveyance portion 24 that conveys the textile M adhering to the belt 23, large tension may be exerted on the textile M. The present embodiment can reduce the tension exerted on the textile M upstream from the brake roller 13.

(4) In the printing apparatus 1 in the present embodiment, the pressure roller 25 is rotated by conveyance of the textile M by the belt 23. With this configuration, while rotating, the pressure roller 25 allows the textile M to adhere to the belt 23 appropriately.

(5) In the printing apparatus 1 in the present embodiment, the brake roller 13 is provided at a position closer to the pressure roller 25 than a position away from the rotation roller by a half-length of the textile M from the feeding roller 11 to the pressure roller 25. With this configuration, the distance from the brake roller 13 to the pressure roller 25 is reduced whereby tension variation for this distance can be suppressed.

(6) The printing apparatus 1 in the present embodiment includes a tension bar 12 configured to apply tension to the textile M fed by the feeding roller 11, between the feeding roller 11 and the brake roller 13. With this configuration, the state of the textile M conveyed between the feeding roller 11 and the brake roller 13 can be kept appropriate.

(7) In the printing apparatus 1 in the present embodiment, the brake roller 13 is a pair of rollers 13*a* and 13*b* having a predetermined rotational resistance. With this configuration, the rotational resistance acts on the textile M as braking force.

(8) In the printing apparatus 1 in the present embodiment, the brake roller 13 pinches the textile M with a pair of rollers 13*a* and 13*b* in cooperation with each other. This configuration increases the friction force acting on the brake roller 13 and facilitates transfer of the rotational resistance to the textile M.

(9) In the printing apparatus 1 in the present embodiment, the brake roller 13 may be configured to rotate along with conveyance of the textile M. This configuration can brake the textile M without damaging the surface of the textile M.

(10) In the printing apparatus according to the second embodiment, the brake device is a pin 15 having a predetermined friction force. With this configuration, the friction force acts as braking force on the textile M.

What is claimed is:

1. A printing apparatus, comprising:

a feeding roller configured to feed and supply a medium from a roll of the medium;

a printing portion configured to make a print on the medium supplied from the feeding roller;

a conveyance portion configured to convey the medium to the printing portion, the conveyance portion including a rotation roller configured to sandwich the medium and rotate along with conveyance of the medium;

wherein the printing apparatus further comprises:

a brake device, being disposed separately from the rotation roller on a conveyance path of the medium between the rotation roller and the feeding roller, and being configured to apply a force against a tension generated by the conveyance portion to the medium.

2. The printing apparatus according to claim 1, wherein the conveyance portion conveys a textile serving as the medium.

3. The printing apparatus according to claim 1, wherein the conveyance portion includes a belt, and the conveyance portion conveys the medium sandwiched between the rotation roller and the belt, and the medium is adhered to a surface of the belt.

4. The printing apparatus according to claim 3, wherein the rotation roller is rotated by conveyance of the medium by the belt.

5. The printing apparatus according to claim 1, wherein the brake device is provided at a position closer to the rotation roller than a position away from the rotation roller by a half-length of the medium from the feeding roller to the rotation roller.

6. The printing apparatus according to claim 1, further comprising:

a tension bar configured to apply a tension to the medium fed by the feeding roller, between the feeding roller and the brake device.

7. The printing apparatus according to claim 1, wherein the brake device is a roller having a predetermined rotational resistance.

8. A printing apparatus, comprising:

a feeding roller configured to feed and supply a medium from a roll of the medium;

a printing portion configured to make a print on the medium supplied from the feeding roller;

a conveyance portion configured to convey the medium to the printing portion, the conveyance portion including a rotation roller configured to sandwich the medium and rotate along with conveyance of the medium; and a brake device disposed between the rotation roller and the feeding roller so as to produce a force acting on the medium against a conveyance force for the medium by the conveyance portion, wherein a tension smaller than a tension exerted on the medium between the brake device and the rotation roller is exerted on the medium between the brake device and the feeding roller;

the brake device is a roller having a predetermined rotational resistance;

wherein the brake device includes a second roller configured to pinch the medium in cooperation with the roller.

9. The printing apparatus according to claim 7, wherein the roller rotates along with conveyance of the medium.

10. The printing apparatus according to claim 1, wherein the brake device is a pin having a predetermined friction force.

11. The printing apparatus according to claim 2, wherein the conveyance portion includes a belt, and the conveyance portion conveys the medium sandwiched between the rotation roller and the belt, and the medium s adhered to a surface of the belt.

* * * * *